US009397430B2

(12) United States Patent
Eliassen

(10) Patent No.: US 9,397,430 B2
(45) Date of Patent: Jul. 19, 2016

(54) ISOLATED ELECTRICAL CONNECTION ASSEMBLY AND METHOD

(71) Applicant: Teledyne Instruments, Inc., Thousand Oaks, CA (US)

(72) Inventor: Christopher M. Eliassen, Deltona, FL (US)

(73) Assignee: Teledyne Instruments, Inc., Thousand Oaks, CA (US)

( * ) Notice: Subject to any disclaimer, the term of this patent is extended or adjusted under 35 U.S.C. 154(b) by 0 days.

(21) Appl. No.: 14/557,055

(22) Filed: Dec. 1, 2014

(65) Prior Publication Data

US 2016/0156126 A1 Jun. 2, 2016

(51) Int. Cl.

| | |
|---|---|
| ***H01R 13/22*** | (2006.01) |
| ***H01R 13/52*** | (2006.01) |
| ***H01R 13/03*** | (2006.01) |
| ***H01R 43/26*** | (2006.01) |

(52) U.S. Cl.

CPC ..... *H01R 13/22* (2013.01); *H01R 13/03* (2013.01); *H01R 13/5219* (2013.01); *H01R 43/26* (2013.01)

(58) Field of Classification Search

CPC ..... H01R 13/22

See application file for complete search history.

(56) References Cited

U.S. PATENT DOCUMENTS 638,230 A * 12/1899 Fischer ..... H01R 13/5219 123/169 R
1,768,522 A * 6/1930 Brown ..... H01F 27/04 174/153 R
2,757,352 A 7/1956 Turley
4,480,018 A * 10/1984 de Bellis ..... H01M 2/24 429/160
4,614,397 A * 9/1986 Flanigan ..... H01R 9/16 439/277
4,707,047 A * 11/1987 Michaels ..... H01R 13/5202 439/271
5,066,905 A * 11/1991 Betton ..... G01R 19/145 200/317
5,948,560 A * 9/1999 Verhoog ..... H01M 2/24 429/160
6,039,609 A * 3/2000 Hauver, Sr. ..... H01R 24/38 439/578
6,067,395 A * 5/2000 Cairns ..... H02G 15/14 385/136
6,227,908 B1 * 5/2001 Aumeier ..... H01R 13/6593 439/186
6,321,021 B1 * 11/2001 Cairns ..... G02B 6/4428 385/135
7,038,339 B2 * 5/2006 Gandrud ..... H02K 5/225 310/71
7,182,617 B1 2/2007 Cairns et al.
7,690,936 B1 4/2010 Snekkevik et al.
7,777,162 B2 * 8/2010 Park ..... F24H 3/004 219/535
8,454,329 B2 * 6/2013 Taguchi ..... F04C 18/0215 310/71

(Continued)

OTHER PUBLICATIONS

Alfred E. Bauer, "Stainless Steel in Water: Galvanic Corrosion and its Prevention a handout prepared for workshops", Nickel Development Institute, Sep. 12, 2014.

(Continued)

*Primary Examiner* — James Harvey

(74) *Attorney, Agent, or Firm* — Procopio Cory Hargreaves & Savitch LLP

(57) ABSTRACT

An isolated electrical connection assembly having first and second conductive terminals of different conductive materials with a non-metallic, annular spacer sandwiched between opposing inner end faces of the terminals. The first terminal having a bore extending inwards from its inner end face, and a pin projects from the opposing inner end face of the second terminal, through a central opening in the spacer, and into the bore. The pin is releasably secured in the bore to provide electrical connection between the terminals. The interfaces between the inner end faces of the terminals and opposing faces of the spacer are sealed to isolate the connection between the second terminal pin and the first terminal bore.

14 Claims, 6 Drawing Sheets

(56) References Cited

U.S. PATENT DOCUMENTS

| | | | | |
|---|---|---|---|---|
| 8,851,939 | B2 | 10/2014 | Bazenas et al. | |
| 9,070,997 | B2 * | 6/2015 | Spalding | H01R 13/46 |
| 2007/0270002 | A1 * | 11/2007 | Braden | H01R 4/646 439/92 |
| 2008/0139031 | A1 * | 6/2008 | Ries | A61N 1/3752 439/277 |
| 2011/0111611 | A1 * | 5/2011 | Zamora Gomez | H01R 13/629 439/180 |
| 2013/0320664 | A1 | 12/2013 | Wium | |
| 2014/0024241 | A1 * | 1/2014 | Siebens | H01R 13/53 439/310 |
| 2014/0144701 | A1 | 5/2014 | Guenter et al. | |
| 2015/0140850 | A1 * | 5/2015 | Suzuki | H01R 9/0524 439/275 |
| 2015/0295363 | A1 * | 10/2015 | Wang | H01R 13/5205 439/578 |

OTHER PUBLICATIONS

PCT/US2015/061677, International Search Report, European Patent Office, Feb. 1, 2016.

PCT/US2015/061677, Written Opinion of the International Searching Authority, European Patent Office, Feb. 1, 2016.

* cited by examiner

ISOLATED ELECTRICAL CONNECTION ASSEMBLY AND METHOD

BACKGROUND

1. Field of the Invention

The present invention relates to isolation of connections between two dissimilar materials from a surrounding conductive environment, such as seawater.

2. Related Art

An electrical connection between electrodes or terminals of two different metallic materials forms a galvanic couple between the mating faces of the terminals when exposed to a conductive environment, such as seawater. This causes the less noble metal to corrode, and is a problem in applications where only a flooded connection is possible and protected electrical continuity is required. Known methods of isolating such connectors involve outer seals or rubber boots surrounding the connection. This typically requires production of custom molded components.

SUMMARY

Apparatus and methods for isolation of electrical connections between terminals of two dissimilar materials from a surrounding conductive environment are provided. In one aspect, an isolated electrical connection assembly comprises first and second conductive terminals of different conductive materials with a non-metallic, annular spacer sandwiched between opposing inner end faces of the terminals. The first terminal has a bore extending inwards from its inner end face, and a pin projects from the opposing inner end face of the second terminal, through a central opening in the spacer, and into the bore. The pin is releasably secured in the bore to provide electrical connection between the terminals. The interfaces between the inner end faces of the terminals and opposing faces of the spacer are sealed to isolate the electrical connection between the second terminal pin and the first terminal bore from the surrounding conductive medium, such as seawater.

In one embodiment, the rod or pin extending from the second terminal has an end portion in threaded engagement with bore in the first conductive terminal to secure the terminals together with the spacer sandwiched between the opposing inner end faces of the terminals. The spacer may be of any suitable non-metallic insulating material, such as thermoplastic material. In one aspect, O-ring seals are mounted in annular grooves in the first and second end faces of the respective first and second terminals and configured for sealing engagement with opposing opposite end faces of the spacer. In another alternative, gasket material layers may be provided between the opposing end faces of the spacer and each terminal end face. Other sealing arrangements may be used in alternative embodiments, such as a chamfer providing an interference fit between mating end faces of the conductive terminals and spacer, a sealing sleeve extending over the mating interfaces, or a heat shrink adhesive layer applied over the mating interfaces between the spacer and respective terminals.

Other features and advantages of the present invention should be apparent from the following description which illustrates, by way of example, aspects of the invention.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for an isolated electrical connection between terminals of dissimilar materials in order to limit or slow the process of corrosion when the connection is exposed to an electrolyte such as sea water.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

Figure 1:
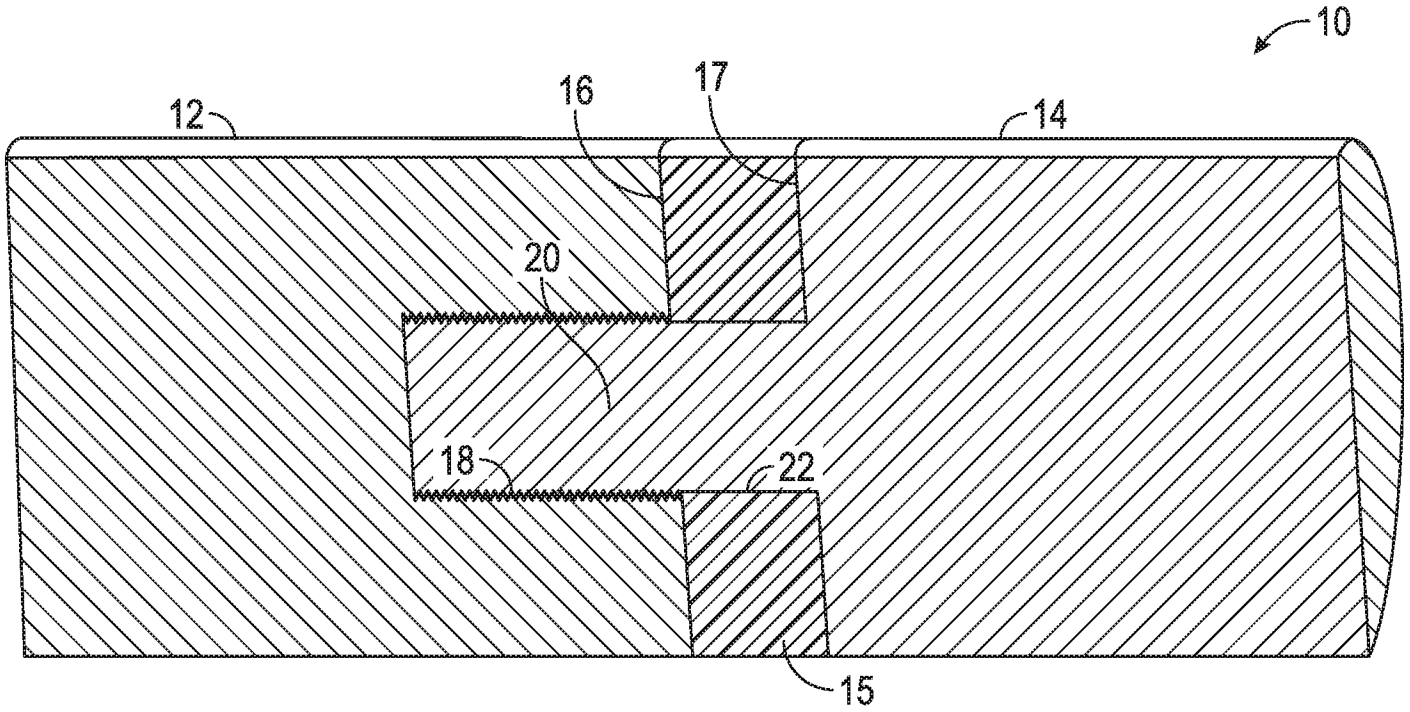
FIG. 1 is a cross-sectional view of one embodiment of an isolated electrical connection device.

FIG. 1 illustrates mating end portions of conductive terminals in one embodiment of an isolated electrical connection or connection assembly 10. Connection assembly 10 basically comprises a first conductive terminal 12 of a first metallic material, a second conductive terminal 14 of a second metallic material different from the first material, and an annular spacer 15 of non-metallic, non-conductive material between the opposing inner end faces 16, 17 of the terminals. The first terminal 12 has a bore 18 extending inwards from end face 16, while the second terminal 14 has a pin or post 20 of reduced diameter extending from end face 17 through the central bore or opening 22 in spacer 15 and into the corresponding aligned bore 18 in the first terminal, which may be of slightly larger diameter than the central bore or opening 22. With this arrangement, the electrical connection between the two terminals is in area 24, where pin 20 engages in bore 18, while the spacer 15 acts to isolate the connection from a conductive environment surrounding the connection, such as sea water or the like. Pin 20 is secured in bore 18 by any suitable means, for example by threaded engagement between threads on the outer surface of pin 20 and inner surface of bore 18, as illustrated. Other connection means may be used in alternative embodiments.

In one embodiment, one of the two terminals of FIG. 1 may be of copper while the other is of titanium. If two such terminals have flat end faces which are in face to face engagement to form a standard, non-isolated connection, the connection forms a galvanic couple when exposed to common electrolyte such as seawater, causing the less noble metal to corrode. In the case of a standard connection between copper and titanium terminals, copper is the less noble material and will corrode over time in the shared electrolyte environment. The arrangement of FIG. 1 isolates the copper/titanium connection from the shared environment, and could be used in any application in which protected electrical continuity is required and only a flooded connection is possible.

Each terminal has a suitable outer end portion for connection to another component in an underwater installation. For example, one terminal may have a crimp lug for connection to a metal wire of the same material as the terminal, while the other terminal has a suitable connection or mounting portion for bolting to a connector body or the like which is of the same metal as the terminal.

Figure 2:
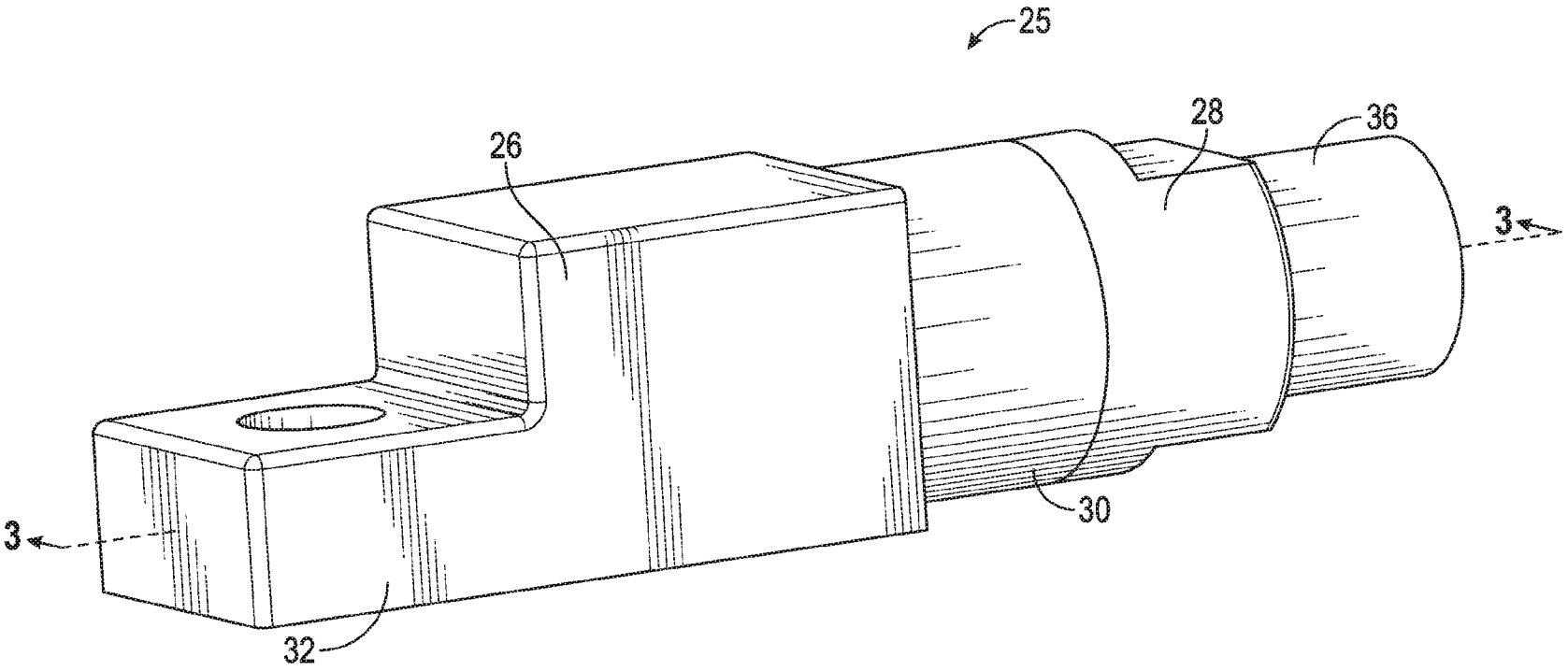
FIG. 2 is a perspective view of a second embodiment of an electrical connection between terminals of two dissimilar materials with an isolation barrier to the surrounding electrolyte.
Figure 3:
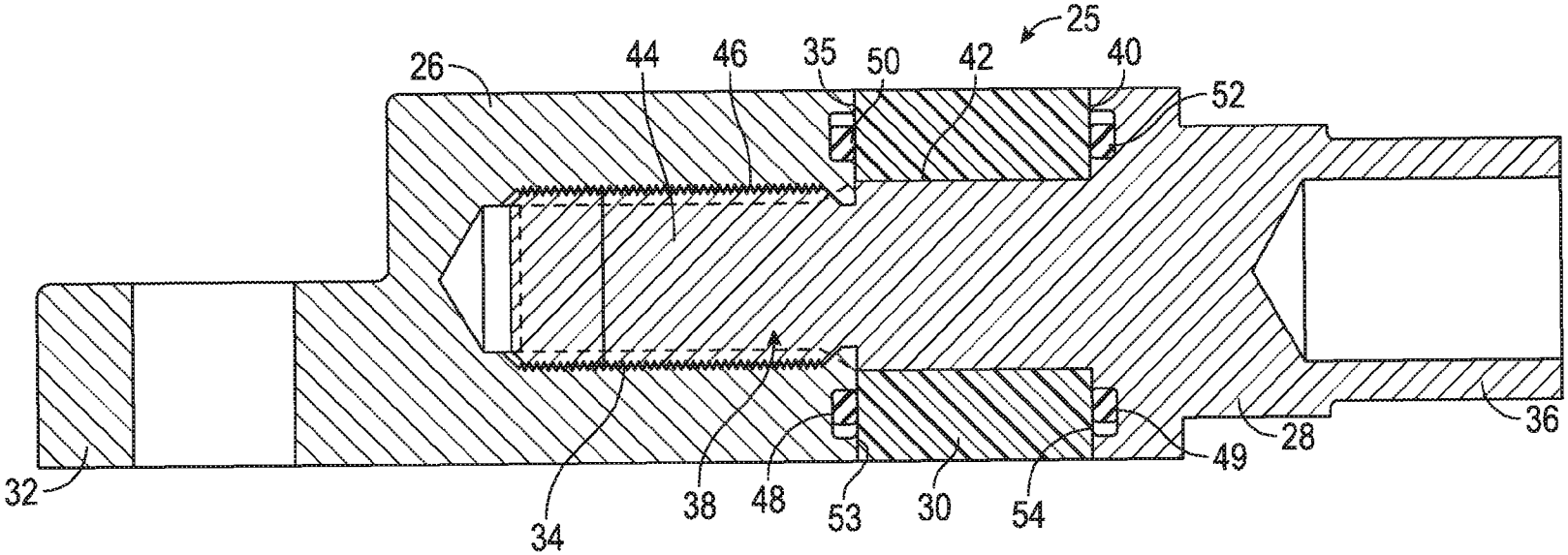
FIG. 3 is a cross-sectional view on the lines 3-3 of FIG. 2.

FIGS. 2 and 3 illustrate an embodiment of an isolated electrical connection assembly 25 designed for electrical connection between a connector canister and a drain wire. Assembly 25 provides isolation between first and second terminals 26, 28 of dissimilar metallic materials in the same way as the connection of FIG. 1, by means of an annular spacer 30 of non-metallic, non-conductive material sandwiched between end faces of the terminals exposed to the external environment. The first terminal 26 is of a first metallic material such as titanium (Ti) while the second terminal 28 is of a second, less noble metallic material such as copper (Cu). The Ti terminal 26 has a mounting portion 32 at one end which can be bolted directly to a titanium connector housing (not illustrated), and a threaded bore 34 extending inward from inner end face 35. The Cu terminal 28 has a crimp lug 36 at its outer end for crimping to a copper wire, and a post or pin 38 extending from inner end face 40. Pin 38 has a first portion 42 of a first diameter extending from end face 40 and configured for engagement in the central opening 45 of spacer 30, and a second portion 44 of slightly smaller diameter having external threads 46 for mating threaded engagement in bore 34, as illustrated in FIG. 3. In one embodiment, spacer 30 is of thermoplastic material but may be of other non-metallic, non-conductive materials in alternative embodiments. The spacer may be of rigid or semi-rigid material in some embodiments, or may be of elastomeric material in other embodiments. As illustrated, the spacer and at least adjacent portions of the two terminals are of substantially matching cylindrical external diameter, but may be of different external shapes in other embodiments.

The inner end faces 35 and 40 of the respective terminals each have an annular indent or groove 48, 49, respectively in which a respective O-ring seal 50, 52 is seated, for sealing engagement with the respective opposing end face 53, 54 of spacer 30. The O-rings act as seals between the spacer and terminal 26, and between the spacer and terminal 28, sealing the contact surfaces of bore 34 and mating portion 45 of pin 38 from the external environment. This allows for an electrical connection between the dissimilar metal terminals, while maintaining isolation of the galvanic couple to the surrounding electrolyte, such as seawater.

Figure 4:
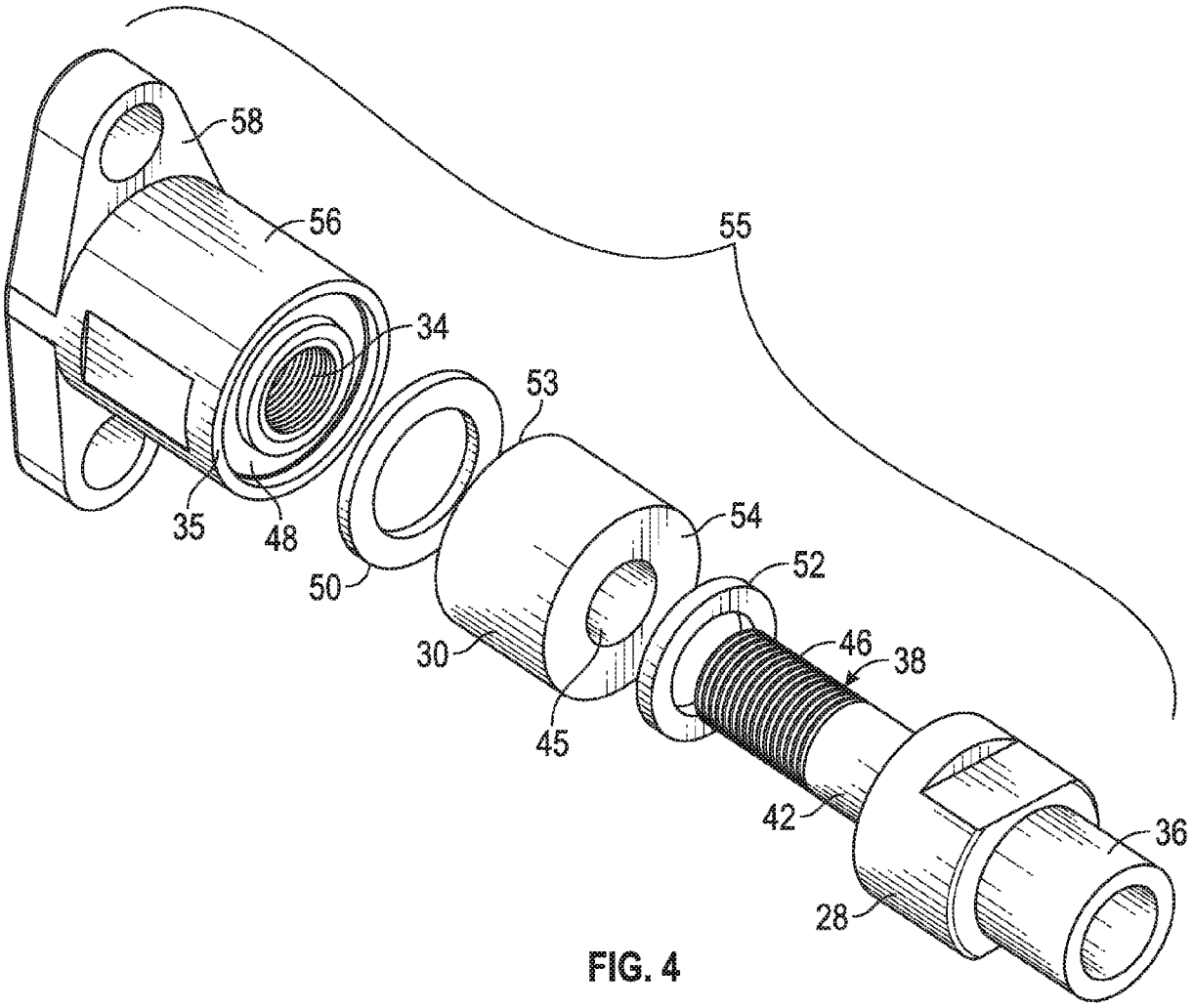
FIG. 4 is an exploded perspective view of the three main components of the electrical connection of FIGS. 2 and 3, but with a modified first terminal with a different style of connector or mounting portion for bolting to a connector body or other item to be connected.

FIG. 4 is an exploded view of the components of an isolated electrical connection assembly 55 similar to that of FIGS. 2 and 3, except that the first terminal 56 is of different external shape to terminal 26 of the previous embodiment, and has a connector mounting portion or flange 58 for bolting to a connector canister or housing which is of different design from mounting portion 32 of the previous embodiment. All other parts are identical to the embodiment of FIGS. 2 and 3, and like reference numerals have been used for like parts as appropriate. As in the previous embodiment, O-ring seals 50, 52 are seated in the respective mounting grooves 48 and 49, pin 38 is extended through opening 42 in spacer 30, and threaded end portion 44 of pin 38 is screwed into bore 34 of terminal 56 until the spacer 30 is sandwiched between end faces 35 and 40 with the opposite end faces 53 and 54 in sealing engagement with the respective end faces 35 and 40 via O-rings 50 and 52. The electrically contacting portions 34, 44 of the two terminals are then isolated from the electrolyte surrounding the outer surfaces of the assembly.

Figure 5:
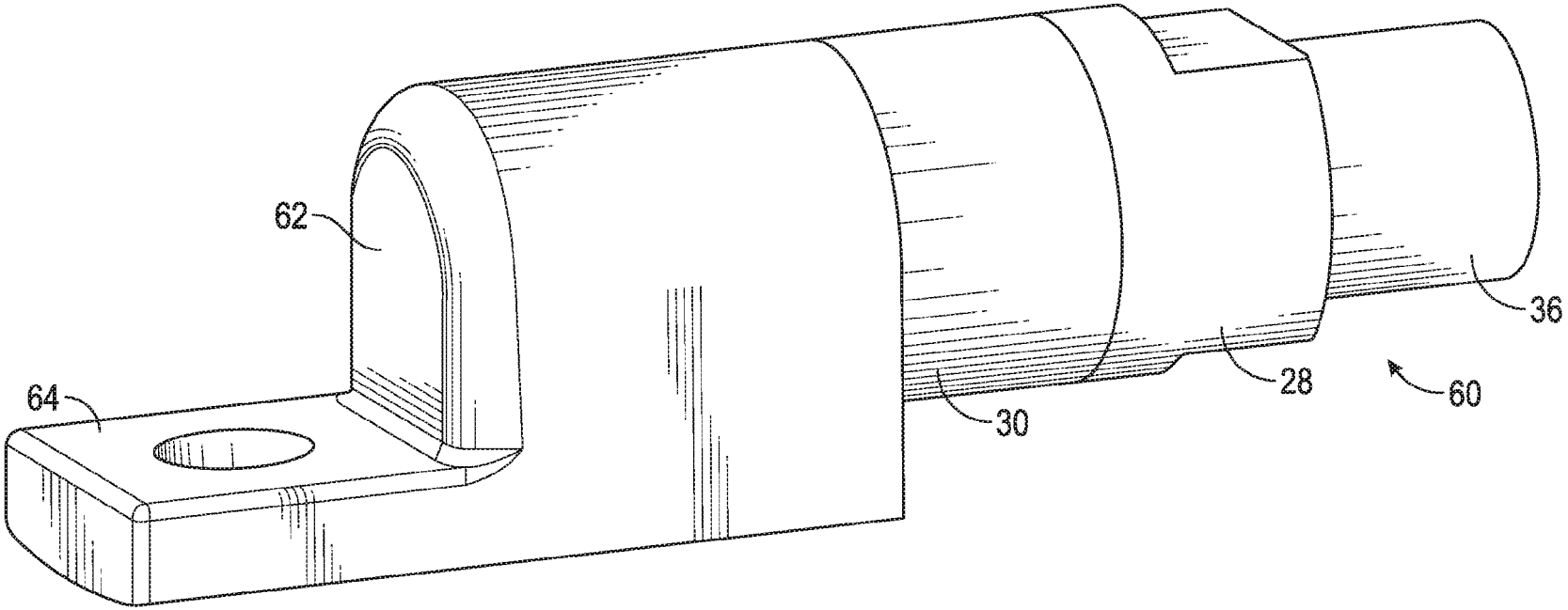
FIG. 5 is a perspective view of a third embodiment of an isolated electrical connection with another modified first terminal.

FIG. 5 illustrates an isolated electrical connection assembly 60 similar to those of FIGS. 2 to 4, with the only difference being the external configuration of first terminal 62, which may be a Ti terminal or a terminal of another conductive metal material, and like reference numerals are used for like parts as appropriate. Terminal 62 has a connector portion 64 similar to that of FIGS. 2 and 3 designed for bolting to a connector housing or canister of the same metal as terminal 62. The connection between the terminals 28 and 62 is exactly the same as that of the previous embodiments, with spacer 30 sandwiched between opposite end faces of the terminals and isolating the internal electrically contacting portions from the external environment.

Figure 6:
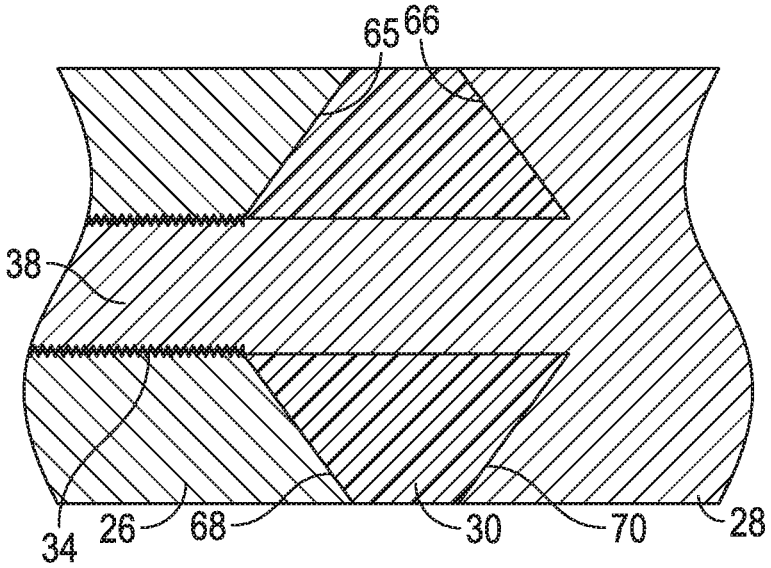
FIG. 6 is a partial cross-sectional view of part of an isolated electrical connection similar to the connections of FIGS. 1 to 4 but illustrating an alternative seal arrangement at the interface between the terminals and spacer.

The above embodiments illustrate an O-ring seal arrangement for sealing the interfaces between opposing faces of the terminals and spacer. Other sealing methods may be used in alternative embodiments, such as a chamfer or taper at the mating faces of the metallic terminals and thermoplastic spacer to provide a taper seal, addition of gasket material between the mating faces of the terminals and spacer, an adhesive lined heat shrink sleeve covering the mating interfaces, or a cold shrink or other stretched elastomeric sleeve of rubber or the like extending over the mating interfaces. Two alternative sealing methods are illustrated by way of example in FIGS. 6 and 7. In FIG. 6, spacer 30 has tapered end faces 65, 66 at opposite ends, and the opposing end faces 68, 70 of first and second terminals 26 and 28 have a matching taper to provide a taper seal when the parts are engaged as in FIG. 6. All other parts of the connection are identical to the previous embodiment, and like references are used for like parts as appropriate.

Figure 7:
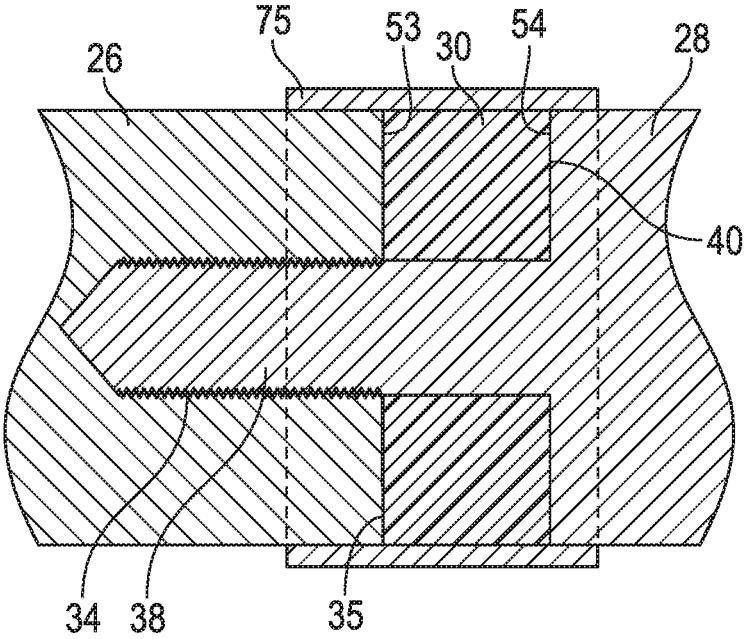
FIG. 7 is a partial cross sectional view similar to FIG. 5 but illustrating another alternative seal arrangement.

In the embodiment of FIG. 7, the mating interfaces between the terminals and spacer are similar to that of FIGS. 2 to 4, apart from the elimination of the O-ring seals and corresponding annular grooves in the terminal end faces, and like reference numbers are used for like parts as appropriate. In this case, the interfaces between the end faces 35 and 40 of the terminals and the corresponding, mating end faces 53, 54 of the spacer 30 are sealed by elastomeric sealing sleeve 75 engaging over the interfaces.

Although the two terminals of dissimilar materials in the embodiments described above are of titanium and copper, respectively, they may be of other conductive metals in alternative embodiments, depending on the material of the connector housing or body to which the first terminal is to be secured and the metal of the cabling or other bodies to be clamped to the rear end of the second terminal. The spacer may be of any suitable non-metallic insulating material, such as thermoplastic material. The isolation assembly of the above embodiments may be used for electrical connection of various items when surrounded by a conductive environment, not only wiring to electrical connectors.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. An isolated electrical connection assembly, comprising:

a first conductive terminal of a first conductive material having a first end face and a bore extending inwardly from the first end face;

a second conductive terminal of a second conductive material different from the first conductive material, the second conductive terminal having an inner end face which faces the inner end face of the first conductive terminal, and a reduced diameter pin extending from the inner end face of the second conductive terminal, an annular spacer of non-metallic and non-conductive material located between the inner end faces of the terminals, the annular spacer having opposite first and second end faces and a central opening; and a sealing mechanism which seals interfaces between opposite first and second end faces of the annular spacer and respective inner end faces of the first and second conductive terminals;

the pin having a first portion extending through the central opening in the spacer and an end portion projecting from the central opening in the spacer into mating engagement in the bore in the first conductive terminal to provide an electrical connection between the terminals, whereby the spacer is sandwiched between the opposing inner end faces of the terminals.

2. The assembly of claim 1, wherein the bore is threaded along at least part of its length and the first portion of the pin has mating threads for releasable threaded engagement in the bore to secure the spacer between the opposing inner end faces of the terminals.

3. A method of isolating a connection between first and second terminals of different conductive materials, comprising:

positioning a non-metallic and non-conductive spacer between opposing inner end faces of first and second terminals of different conductive materials;

extending a pin projecting from the inner end face of the second terminal through an opening in the spacer and into a mating bore extending inward from the inner end face of the first terminal;

securing the pin in the bore with the spacer sandwiched between the inner end faces of the terminals; and sealing the interfaces between opposite first and second end faces of the spacer and respective inner end faces of the first and second terminals to isolate the connection between the second terminal pin and the first terminal bore.

4. The assembly of claim 1, wherein the sealing mechanism comprises a first O-ring seal in sealing engagement between the inner end face of the first terminal and the inner end face of the spacer and a second O-ring seal in sealing engagement between the inner face of the second terminal and the second end face of the spacer.

5. The assembly of claim 4, wherein the inner end face of the first terminal has a first annular groove in which the first O-ring seal is seated and the inner end face of the second terminal has a second annular groove in which the second O-ring seal is seated.

6. The assembly of claim 1, wherein the opposite first and second end faces of the spacer engage respective inner end faces of the first terminal and the second terminal, and the opposing inner end face of the first terminal and first end face of the spacer and the opposing inner end face of the second terminal and second end face of the spacer each have matching tapers comprising the sealing mechanism, the tapers being configured to form respective first and second taper seals when the spacer is secured between the inner end faces of the terminals.

7. The assembly of claim 1, wherein the spacer has an outer diameter and the first and second terminals have outer diameters substantially matching the outer diameter of the spacer at least over a part of the length of the respective terminal extending from the inner end face of the first terminal and the inner end face of the second terminal, respectively.

8. The assembly of claim 7, further comprising a first interface between the inner end face of the first terminal and the first end face of the spacer and a second interface between the inner end face of the second terminal and the second end face of the spacer, the sealing mechanism comprising a sealing sleeve extending over the outer surface of the spacer and the first and second interfaces.

9. The assembly of claim 8, wherein the sealing sleeve is selected from the group consisting of a heat shrink adhesive layer and a sleeve of elastomeric material.

10. The assembly of claim 1, wherein the spacer is of substantially rigid thermoplastic material.

11. The assembly of claim 1, wherein the first terminal has an outer end comprising a mounting portion configured for mounting the terminal on a connector housing of the same material as the first terminal.

12. The assembly of claim 11, wherein the first conductive material is titanium.

13. The assembly of claim 1, wherein the first conductive material is titanium and the second conductive material is copper.

14. The assembly of claim 1, wherein the second terminal has an outer end portion comprising a crimp lug configured for connection to a wire of the same conductive metal material as the second terminal.

* * * * *